United States Patent [19]

Calkins

[11] 4,362,169

[45] Dec. 7, 1982

[54] AIR FLOW DRY BOWL PIPE

[76] Inventor: Edward H. Calkins, 333 E. Main St., Gaylord, Mich. 49735

[21] Appl. No.: 213,725

[22] Filed: Dec. 5, 1980

[51] Int. Cl.[3] ..... A24F 1/22

[52] U.S. Cl. ..... 131/196; 131/198 R; 131/220; 131/226; 131/230

[58] Field of Search ..... 131/196, 195, 194, 198, 131/204, 209, 216, 217, 218, 220, 222, 226, 230

[56] References Cited

U.S. PATENT DOCUMENTS

| | | | |
|---|---|---|---|
| 582,423 | 5/1897 | Henne . | |
| 719,683 | 2/1903 | Moehlenbrock . | |
| 858,737 | 7/1907 | Marshall . | |
| 984,335 | 2/1911 | Wood . | |
| 1,461,126 | 3/1921 | Lasure . | |
| 1,585,746 | 7/1925 | Watters . | |
| 1,627,605 | 5/1927 | Homan | 131/220 X |
| 1,756,695 | 4/1930 | Lucas | 131/220 X |
| 2,138,322 | 5/1936 | Douglas . | |
| 2,329,578 | 10/1941 | Andis . | |
| 2,373,592 | 11/1943 | Orrington . | |
| 2,614,568 | 5/1950 | Batty . | |
| 2,637,327 | 5/1953 | Nadelson | 131/220 X |
| 2,637,327 | 5/1950 | Nadelson . | |
| 2,718,892 | 10/1949 | Holderman . | |
| 3,028,867 | 6/1960 | Calkins . | |
| 3,091,246 | 7/1960 | Mahieux . | |
| 3,185,163 | 8/1963 | Buckingham . | |
| 3,292,639 | 6/1964 | Zarikta . | |
| 3,422,821 | 5/1965 | Calkins . | |

FOREIGN PATENT DOCUMENTS

| | | |
|---|---|---|
| 58255 | 1/1891 | Fed. Rep. of Germany . |
| 360466 | 4/1906 | France . |
| 24471 | of 1896 | United Kingdom . |
| 203919 | 9/1923 | United Kingdom . |
| 264914 | 1/1927 | United Kingdom . |

OTHER PUBLICATIONS

Plastics Design Forum, Nov./Dec. 1977 issue.

*Primary Examiner*—Stephen C. Pellegrino
*Attorney, Agent, or Firm*—Imirie and Smiley

[57] ABSTRACT

A smoker's pipe of the dry bowl type is disclosed which has a ceramic inner bowl secured at its lower end to the lower end of an outer plastic bowl in a manner to space the bowls radially apart for the establishment of a cooling air space between the bowls. The pipe has a stem provided with an auxiliary fresh air inlet that is in communication with one end of a horizontal longitudinally extending passageway located in the bottom of the inner bowl below the combustion chamber and in communication therewith. The other end of the passageway is in communication with a cooling chamber to communicate smoke from the inner bowl to a mouthpiece fitted in the outer end of the stem. The mouthpiece has an insert cluster containing a smoke passage tube and a liquid contaminant tube, the latter of which is received within the open end of a liquid absorber mounted on a plug that is frictionally fitted in a bore formed in the front end of the stem below the bowl assembly. A bore having a curved bottom in the mouthpiece cooperates with a slot in the bottom of the smoke passage tube to constrain the smoke to flow over an S-shaped path for enhanced cooling.

26 Claims, 5 Drawing Figures

AIR FLOW DRY BOWL PIPE

BACKGROUND OF THE INVENTION

1. Field of the Invention

The present invention relates generally to smoker's pipes, and more particularly, to a new and improved smoker's pipe of the dry bowl type using auxiliary and cooling air flows.

2. Description of the Prior Art

Conventional pipes, including filtered pipes and those equipped with metal fittings which form condensation and taint flavor, function today the same way they have for centuries. A single channel, closed at the heel end, connects the bowl, shank, stem and bit. Liquids generated while smoking run down this single channel and build up in the heel of the bowl. Filters and fittings in the smoke channel slow or modify the process, but eventually the liquids will enter the bowl and will be absorbed by the tobacco. This condition generally continues until about one-fourth of the tobacco in the lower bowl becomes saturated with collected liquids.

When the burning tobacco in the upper part of the bowl reaches the saturated tobacco in the lower bowl, combustion is gradually reduced as the degree of wetness increases, and the condition becomes akin to that of trying to burn wet leaves. From this level downward, the flavor supporting carbon cake built up on the inner walls of the pipe begins to disintegrate and disappear. Moreover, the heat of descending combustion above this level progressively increases the temperature of the confined liquids, causing excessive heat and accelerating the absorption of contaminants.

These circumstances sustain the development of foul odors and bad taste. In addition, the smoke must pass through this collection of hot, acrid consensate producing a biting sensation on the smoker's tongue.

In my U.S. Pat. No. 3,028,867, a dry bowl pipe is disclosed wherein the bowl and stem are integrally molded of plastic material, and wherein the stem has an additional passage within which a cartridge of absorbant material is disposed so as to collect the liquid combustion products and efficiently remove them from the smoke path. The absorbant cartridge has an outer end screwed into a threaded bore in the front end portion of the stem below the bowl. The cartridge has a flattened nipple whereby it can be grasped exteriorally of the pipe to insert and remove the cartridge which has an axially bored inner end to receive a tube which is fitted in a bore in the mouthpiece. The tube has a radial aperture in its side wall so as to provide a smoke path from the burning tobacco in the bowl to the smoker's mouthpiece.

An improved dry bowl pipe is disclosed in my U.S. Pat. No. 3,422,821 wherein the bowl assembly is composed of an outer bowl of plastic and an inner bowl of ceramic material. The inner surface of the outer bowl is formed with a plurality of narrow vertical ribs that engage the inner bowl and hold it spaced from the outer bowl while creating a plurality of air grooves whereby air can flow over the inner bowl for cooling.

The inner bowl is held in place by a resilient metal split washer which is seated on the upper end of the inner bowl under an annular clamping ring that is screwed into the internally threaded upper end of the outer bowl in engagement with the split washer.

Pipes formed in accordance with my aforesaid patents, have been well received by smokers. They function extremely well to provide a smooth, cool smoke without the foul taste attendant to the operation of conventional smoker's pipes. However, the pipes are somewhat expensive to fabricate because of special structural details including the vertical ribs between the inner and outer bowls, the manner of joining the inner and outer bowls together, and the manner of mounting the absorber cartridge.

However, pipes having an inner bowl of a ceramic material develop a serious problem whereby moisture travels transversely through the ceramic bowl and accumulates as droplets on the outer side thereof. In addition, the pipes smoke "raw" until a layer of carbon is built up on the inside surface, a process that could take several days or even weeks.

SUMMARY OF THE INVENTION

Accordingly, it is an object of the present invention to provide a dry bowl pipe which possesses all of the advantages of the pipes of my earlier patents while being less costly to fabricate on a mass production basis and providing an even smoother, cooler smoke.

Another object of this invention is to construct a dry bowl pipe in which smoke from the burning tobacco is passed first through a cooling passage in the bottom of the bowl, is mixed with a metered fresh air flow then is passed to a cooling chamber, and then to a final cooling cluster in the mouthpiece.

The present invention has a further object in the construction of a smoker's pipe having inner and outer bowls separated by a surrounding air cooling passage wherein a protruding exit is formed on the bottom of the inner bowl so as to supply the smoke directly to a cooling chamber without contacting any intermediate members.

A further object of this invention is to construct a dry bowl smoker's pipe in which smoke and liquid components are kept entirely separate throughout the entire pipe assembly.

The present invention has yet another object in maintaining the tobacco charge completely dry from the top to the bottom of the bowl so as to maintain uniform quality of the smoke and uniform combustion, enhancing carbon-cake build-up over the entire inner bowl wall.

A further object of this invention is to construct a smoker's pipe which is self-supporting in an upright position and has cooling air channels which remain open even when the pipe is resting on a flat surface.

In addition, the present invention in one embodiment thereof incorporates a ceramic bowl having porous inner walls and non-porous glazed outer walls and glazed smoke passageways. The glazed surfaces permit easy cleaning and prevent moisture from travelling through the wall and droplets forming on the outside. The porous inner wall permits a tightly adhering pyrolyzed inner carbon layer to be formed thereon.

The present invention exhibits numerous advantages over conventional and dry bowl pipes of the prior art. Significant among these advantages are the development of a smooth, uniform and cool smoke; the addition of cooling air to the hot smoke; the separation by an air cooling chamber of inner and outer bowls so as to maintain the outer surface of the pipe cool to the touch; the provision of enhanced air cooling and the maintenance of the cooling flow even when the pipe is placed at rest on a flat surface; improved moisture separation; the elimination of contaminated liquids from the smoke flow passage; and the development of a dry bowl pipe which may be economically produced using mass production techniques.

Other objects and advantages of the present invention are described in or will become apparent from the following detailed description of a preferred embodiment when taken in conjunction with the accompanying drawings.

DESCRIPTION OF THE PREFERRED EMBODIMENT

Figure 2:
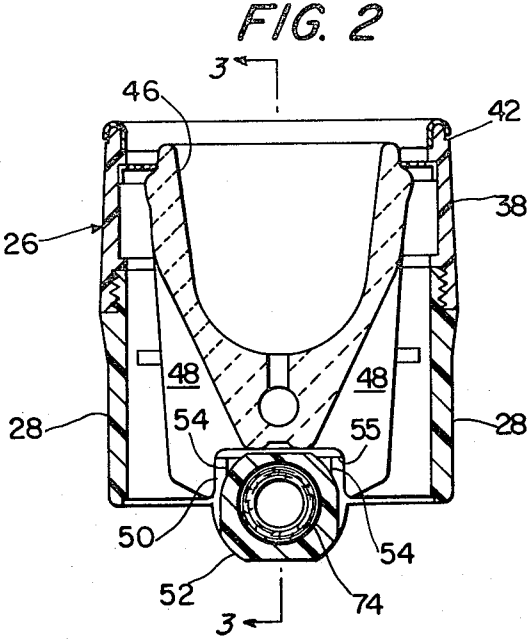
FIG. 2 is a transverse sectional view of the pipe bowl taken along line 2—2 of FIG. 1.
Figure 1:
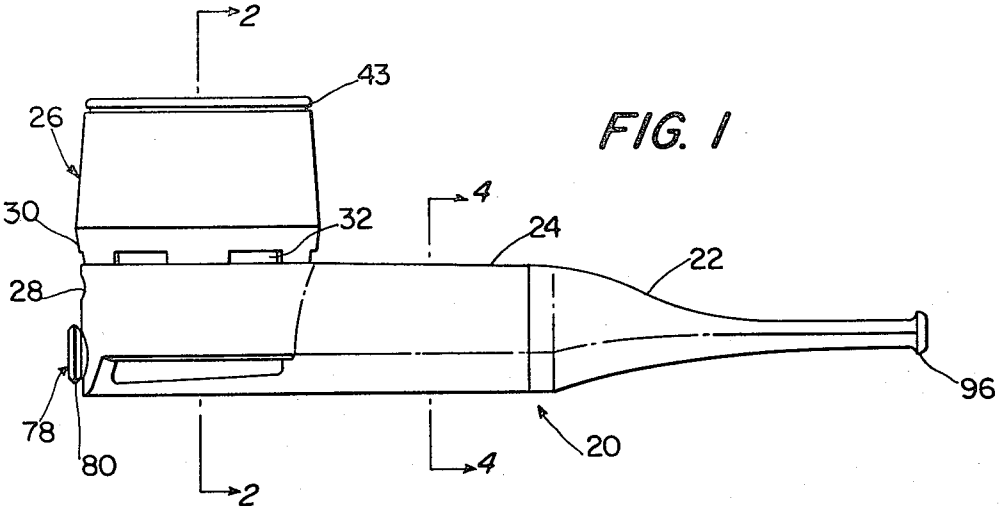
FIG. 1 is a side elevational view of a preferred embodiment of an improved air insulated dry bowl pipe according to the present invention.
Figure 3:
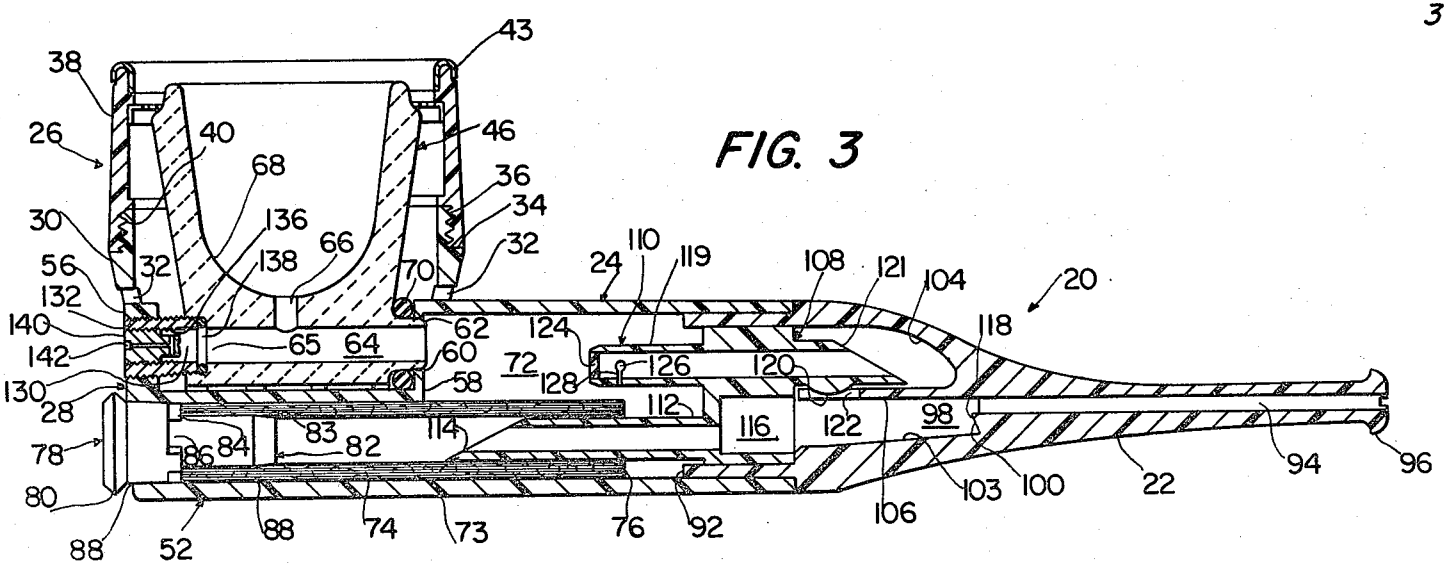
FIG. 3 is a longitudinal sectional view of the pipe of FIG. 2, taken along line 3—3 of FIG. 2.

Referring now to the drawings in which like numerals refer to like elements in the several views, and initially to FIGS. 1-3, there is shown a smoker's pipe 20 having a mouthpiece 22 which is removably attached to a stem 24 provided with a bowl assembly 26. The bowl assembly 26 includes a generally cylindrical, hollow base ring 28 on which is mounted an annular collar 30 having a plurality of air passage openings 32. Collar 30 has an upper end that is inwardly offset so as to form a shoulder 34 and has exterior threads 36.

A generally cylindrical outer bowl 38 is provided with interior threads 40 (FIG. 5) for cooperation with threads 36 of the collar 30. For esthetic reasons, bowl 38 could also have a conical shape. An outwardly directed flange or lip 42 at the upper end of the outer bowl 38 receivingly mounts a protective metal ring 43.

A ceramic inner bowl 46 is mounted inside base ring 26 spaced concentrically from outer bowl 38. An annular metal screen 47 extends between outer bowl 38 and inner bowl 46 and prevents tobacco and other foreign objects from falling therein and lodging therebetween. Screen 47 also serves as a heat shield to convey heat away from the top of inner bowl 46. Preferrably, screen 47 is retained inside outer bowl 38, abutting the lower end of metal ring 43, by being force fitted therein.

Figure 5:
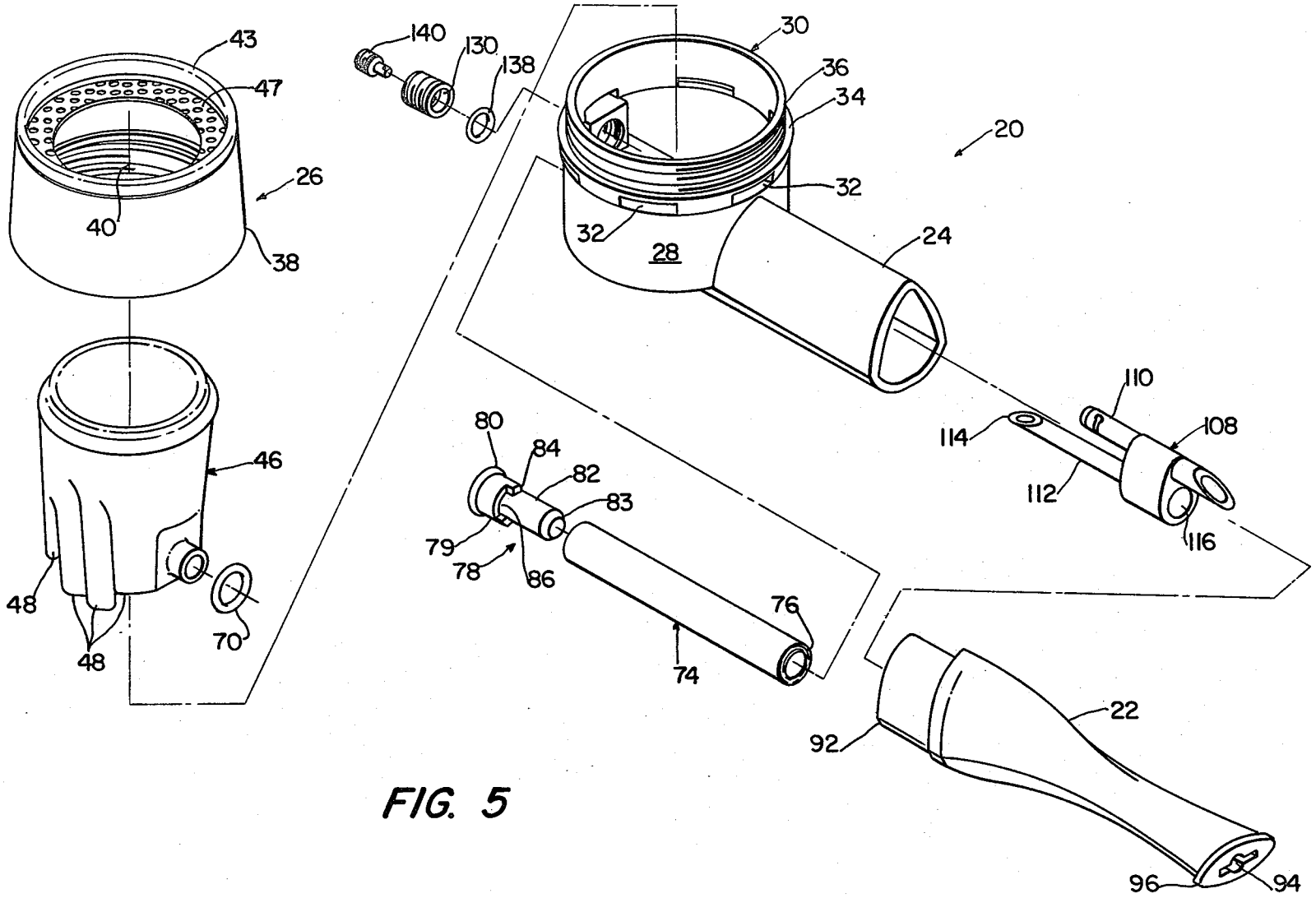
FIG. 5 is an exploded perspective view of the pipe of FIG. 1.

As can be appreciated from FIGS. 2 and 5, inner bowl 46 contains a plurality of cooling fins 48 at the bottom end thereof. Each of the cooling fins 48 extends downwardly from the main portion of the inner bowl 46 and defines a central notch or cut-out 50 for receiving a generally rectangular support shank 52 extending longitudinally within the stem 24. The side walls of shank 52 are curved inwardly as shown in FIG. 3 at the mid portion thereof and two pairs of integral supports 54 are located at each end thereof for receiving the corresponding ends 55 at the bottom of inner bowl 46. Thus, cooling fins 48 extend around support shank 52 and the bottom of inner bowl 46 is spaced above the top of support shank 52. As a result of this construction, air flow passageways are provided between the cooling fins 50 and around the top of shank 52 between supports 54. All of this structure serves to maintain the temperature of the inner bowl 46 at a reduced level for the comfort of the smoker.

The generally cylindrical, hollow base ring 28 extends around support shank 52 in the area where the inner bowl is seated. Base ring 28 crosses the longitudinal center line of the pipe at a front wall 56 and a rear wall 58 (see FIG. 3). Rear wall 58 is provided with a circular opening 60 through which a protruding nipple 62 of the inner bowl 46 extends. Coaxial with nipple 62 is a smoke passageway or bore 64 which extends longitudinally and horizontally across the bottom of and completely through inner bowl 46 in the area of the cooling fins 48 and terminats in an enlarged front opening 65 in inner bowl 46. Midway in passageway 64 and communicating therewith is a downwardly extending vertical passageway 66 which communicates with the interior of inner bowl 46 as shown. As can be seen in FIG. 3, the bottom of inner bowl 46 has slightly sloped sides 68 symmetrically converging on the centrally located vertical passageway 66, which serves to direct the advancing combustion toward the passageway 66 and to provide even burning.

Protruding nipple 62 can be formed as an integral part of inner bowl 46 or can be provided by inserting a separate tube or sleeve within an appropriate bore in the bottom of the bowl. The separately inserted tube or sleeve can be attached to inner bowl 46 in any suitable manner so as to provide an air-tight, integral assembly. Alternatively, nipple 62 can be omitted entirely and replaced with a recessed area about the outer opening for positionably receiving a thicker O-ring seal that would also sealingly engage rear wall 58. However, protruding nipple 62 does provide a means for mounting and aligning inner bowl 46 inside outer bowl 38.

A washer or O-ring 70 is disposed around nipple 62 between rear wall 58 and the outer side surface of inner bowl 46. O-ring 70 may be made of any suitable heat-resistant material which will form an air-tight seal between inner bowl 46 and the shank of pipe 20. A washer constructed of aluminum or Teflon is particularly well suited for this application although it should be appreciated that any number of different materials could be used. At this point, it is noted that nipple 62 protrudes slightly beyond the inner side of rear wall 58 so as to carry the exiting smoke well into an enlarged cooling chamber 72 in stem 24 without having the smoke pass through any intermediate members or come into contact with any other portions of the assembly. This minimizes the exposure of the smoke to contaminants and assures that any liquid condensate which may develop around nipple 62 falls clear of the rearward end thereof without leaking around opening 60 and onto O-ring 70.

Referring to FIGS. 2 and 3, it can be appreciated that the bottom of base ring 28 terminates above the level of the bottom of shank 52 and that shank 52 preferably has a flat bottom wall 73. In this manner, open air flow passages are established from the bottom to the top of bowl assembly 26 between the outer and inner bowls 38 and 46 thereof. Screen 47 at the upper end of the outer bowl 38 also defines an annular air passage opening so as to allow the air flowing upwardly by convection to exit around the inner bowl 46. The upward flow of air is further enhanced by the presence of the intermediate air openings 32 formed in collar 30.

Collar 30 and cylindrical member 28 may be made as a single molded member or may be formed separately and integrally joined by welding, by adhesives or by any other suitable technique. Stem 24, collar 30, and outer bowl member 38 are preferably formed from plastic engineering resins or plastic materials having desired impact resistance and toughness, and capable of maintaining their properties over a wide temperature range. Typical of these are the polycarbonate resins (such as "Lexan," a product of General Electric Company), and an even better thermoplastic polyester,-polybutylene terephthalate (PBT) (such as "Valox" PBT, a product of General Electric Company). Other plastics include the high performance, high strength polysulfones, (such as "Udel," a product made by the Union Carbide Company), the oxymethylene polymers and copolymers, acrylic polymers and copolymers, and other high strength, high impact and thermally stable polymers and plastics.

Inner bowl 46 is preferably formed from refractory ceramic materials capable of withstanding sharp changes in temperatures, resisting abrasion, and having desirable heat capacity. Typical are the refractory materials made of kalonite, silicon carbide, zirconia, fire clay, dolomite, carbon, sillimanite, and the like. The bowl can also be formed from meerschaum or may be made from a good quality briar or other suitable wood.

A presently preferred embodiment of inner bowl is made of a conventional mechanical porcelin, such as koalin clay from Georgia. The outside of inner bowl 46 and all of the walls defining horizontal passageway 64 are glazed. These glazed ceramic portions not only make bowl 46 non-porous to prevent moisture penetrating therethrough, but also provide surfaces that are easily washable and, of particular importance in passageway 64, will not absorb any of the liquids that accumulate from smoking.

A presently preferred embodiment of inner bowl 46 also utilizes a pyrolyzed inner carbon layer formed from a substance having a high carbon content. Preferable substances are those with a high sugar content and in a fluid state. The presently preferred sugary substance is ordinary bee's honey of any commercial variety. Other sugary substances are sugar syrup (sugar and water), corn syrup, maple syrup, molasses, or a mixture of the foregoing.

The pyrolyzing process is critical because if improperly done, the coating could either not adher properly, on the one extreme, or be completely burnt off, on the other extreme. A presently preferred process is as follows. After inner bowl 46 has been shaped and fired, it is cooled. Also, the inner surface is roughened up, such as with an abrasive, to increase the porosity. The inner surface is then completely coated with a thin layer of a sugary substance, such as honey, and the bowl is placed in a heated environment. Preferably, the bowl is placed for a few minutes, such as 4 to 9 minutes, on a heated surface located in an open space that is at atmospheric temperature and pressure. The bowl is then removed and left to cool naturally in an atmospheric temperature and pressure environment.

In one example, the inner surface of an unfired bowl was manually roughened up using water, was fired, and a commercial grade of honey was applied with a conventional paint brush to completely cover the roughened inner surface of the bowl. The bowl was then placed on a heated calrod unit of a conventional electric stove for about 6 minutes. The stove was in an open room at about 70° F. at atmospheric pressure and the burner unit heat control was on the "HIGH" setting. A temperature measurement of the burner revealed that the burner was at about 1,500° F.

In another example, the above process was repeated, but a loosely fitted cover having vent holes in the horizontal surface top that permitted ample natural air circulation underneath the bottom sides and around the bowl was placed over the bowl without touching it during the last 2 to 3 minutes of the 6 minute heating step. This step resulted in an effective, even pyrolysis of the upper inner surface of the inner bowl.

In a further embodiment, a greater porosity of ceramic inner bowl 46 can be obtained by adding finely pulverized sawdust to the green clay mix before firing. The mix is then molded and the molds are fired in a conventional way using a conventional kiln. The firing burns away the sawdust leaving a porosity proportionate to the quantity of sawdust particles in the mix. An examplary amount of sawdust added is 20% by volume of the final composition. The bowls can then be coated with a conventional glaze and refired to produce the final glazed porcelin inner bowl 46. Such a bowl will have a porous inner portion and an outer, glazed non-porous surface. The porous inner bowl portion promotes the build up of the inner carbon cake. A more porous inner bowl 46 also has the advantage of being lighter in weight.

If desired, the plastic materials used in connection with the present invention may contain various siliceous fillers, including $SiO_2$, fiberglass re-enforcing fillers, and the like. Other non-metallic refractory materials which may be used herein are the borosilicate glasses of the "Pyrex" type.

The pipe 20 according to the present invention includes an assembly for preventing liquids, such as those that condense from the smoke or come from the mouth of the smoker, from gaining access to the inner bowl 46 or the tobacco therein so that the inner bowl remains relatively dry whereby the tobacco burns freely and substantially evenly and completely. This assembly includes an elongated, hollow, flexible absorbent tube 74 formed from convolutions of paper, like a conventional drinking straw, which may be provided with minute perforations through the wall thereof, if desired. A wrapping of suitable thermoplastic material 76, such as polyethylene, surrounds the tube like a matrix section surrounding a core section. One end of absorbent tube 74 is mounted on a plug 78 that comprises an enlarged head 79 with a terminal flange 80 and a smaller, cylindrical body 82 having an outer diameter sized to be frictionally received inside absorbent tube 74. The distal end 83 of plug body 82 is tapered to permit easier insertion into absorbent tube 74 and a plurality of integral lugs 84 extend longitudinally from head 78 along body 82 a short distance. Slots 86 are thereby provided between lugs 84 for preventing pressure build-up within the interior of tube 74 and permitting liquids to travel around the end and be absorbed by the inner end layers of absorbent tube 74. In this way, advancing liquids flowing toward tube 74 are not retarded in any way during the use of pipe 20.

Support shank 52 of pipe stem 24 is formed with a bore 88 (FIG. 2) within which plug 78 and absorbent tube 74 are mounted. The outer diameter of absorbent tube 74 is somewhat less than the diameter of bore 88 so that absorbent tube 74 is freely admitted therein, and the diameter of plug head 79 is sized and tapered to frictionally fit within bore 88 to maintain plug 78 and attached absorbent tube 74 in place. Plug flange 80 overlies the front end of bore 88 and is provided so as to enable plug 78 to be easily inserted into and removed from bore 88. In addition, flange 80 and tapered plug provide an air-tight head seal 79 at the front end of bore 88. Thus, absorbent tube 74 and plug 78 can be easily removed and absorbent tube 74 replace with a fresh assembly whenever it becomes overly contaminated with liquids, tars or other contaminants.

Figure 4:
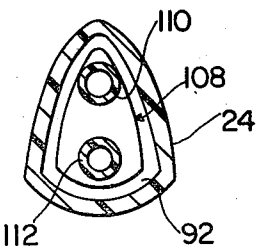
FIG. 4 is a transverse sectional view taken along line 4—4 of FIG. 1.

As can be appreciated from FIGS. 4 and 5, stem 24 is oval or tear-drop shaped as is the coupling end 92 of mouthpiece 22. The coupling end 92 has an outer dimension matched with the inner dimension of stem 24 such that the mouthpiece may be frictionally slid into place or removed for cleaning. Mouthpiece 22 has a longitudinal bore 94 therein which extends from the bit end 96 into a second phase cooling chamber 98. Chamber 98 is formed by a bore having a first rear wall 100 from the end of bore 94 to the bottom 102 thereof. A second, circular, rear wall 104 is formed above bore 88 and is separated therefrom by a partition 106.

Disposed within the end of mouthpiece 22 adjacent chamber 98 is a removable cluster assembly 108 containing a smoke passage tube 110 and a liquid tube 112. Liquid tube 112 extends toward the front or bowl end of pipe 20 and has an inclined end 114 that is adapted to be received within the other end of absorbent tube 74, as shown in FIG. 3. The other end of liquid tube 112 opens onto a compartment 116 which communicates with chamber 98 and bottom 102. Bottom 102 is preferably inclined downwardly from mouthpiece 22 towards cluster assembly 108 so that any liquids that collect tend to drain down toward the inclined end 114 of liquid tube 112 where they are absorbed by absorbent tube 74. First rear wall 100 meets bore 94 at a relatively sharp lip 118 which has the effect of preventing any liquids from running back up bore 94 to bit end 96.

Smoke passage tube 110 extends approximately equally on both sides of cluster 108 having an upstream portion 119 disposed within first phase cooling chamber 72 and a downstream portion 121 disposed within second phase cooling chamber 98 adjacent second rear wall 104. A depending boss 120 is formed along part of the bottom of downstream portion 121 of tube 110 and partition 106 is bifurcated by a slot 122 which together provide a passageway through which the smoke may pass. As can be appreciated from FIG. 3, the design of smoke passage tube 110, rear wall 104, boss 120, and partition 106 with slot 122 results in the smoke passing through smoke tube 110 and then curving around through slot 120 into the lower portion of cooling chamber 98 and then curving around once again whereupon it passes through bore 94. The smoke thus is constrained to traverse an S-shaped flowpath which develops some turbulence and quite effectively promotes cooling and moisture separation.

As shown in FIGS. 3 and 5, an end closure or plug 124 is located in the forward end of smoke tube 110 and tube 110 is provided with two aligned side orifices 126 and a transverse bottom slot 128 extending upwards into the bottoms of orifices 126. Closed end 124 prevents any liquids accumulating in smoke tube 110 and cooling chamber 98 from being blown into bowl horizontal passageway 64 during a reverse air blast applied at bit end 96 by the smoker. In this case, the length of partition 106 can be substantially reduced to prevent excessive moisture accumulation and slot 122 eliminated. However, comparable smoke curving is still retained as a result of the smoke having to enter tube 110 through orifices 126.

As mentioned above, bowl horizontal passageway 64 extends longitudinally completely through inner bowl 46 and terminates in enlarged front opening 65. Coaxially aligned with opening 65 when inner bowl 46 is mounted in bowl assembly 26 is a threaded orifice 132 in base ring front wall 56 that is also located directly above bore opening 88. Orifice 132 receives an externally threaded barrel screw 134 having a threaded bore 136 therethrough. The forward end of barrel screw is provided with a slot (not shown) so it can be screwed into orifice 132. The rearward end of barrel screw sealingly engages an O-ring 138 mounted in inner bowl front opening 65. An externally threaded jet plug 140 mates with and is received by threaded bore 136 of barrel screw 134. Jet plug 140 has an internal T-shaped bore 142 therein, the transverse section of bore 142 being located in the rearward portion thereof and the forward portion being in communication with the air outside pipe 20. The terminal end surface 144 of plug 140 has a concave shape. By its construction, jet plug 140 breaks up the incoming fresh air and causes it to be sprayed into horizontal passageway opening 65. This permits faster and gentler mixing of the fresh air with the smoke and prevents rapid breakup and resulting condensation of the smoke that would result if the fresh air were admitted as a solid stream.

Inner bowl 46 is rigidly attached inside outer bowl 38 solely by barrel screw 134 forcing the rearward side of bowl 38 into a retaining engagement with rear wall 58 of base ring 28. As mentioned above, supports 54 support bowl ends 55 to provide vertical and transverse stability.

The dimensions and volumes of the various fluid passageways, bores, and chambers is very important and very critical. For example, if the relative sizes of bore 94, chambers 98 and 72, and passageway 64 are not chosen properly, then the pipe either will draw too quickly with improper cooling of the smoke and too rapid burning of the tobacco (passageway 64 being large relative to chambers 98 and 72 or chambers 98 and 72 being too small), or will be too hard to draw (chambers 98 or 72 being too large relative to bore 94 or passageway 64, respectively, causing a large pressure drop at the respective junctions). In a conventional pipe, such as depicted in U.S. Buckingham Pat. No. 3,185,163, incorporated herein by reference, the bore in the bit is approximately the same diameter (about 0.125 inches) as the bores in the shank and into the bowl. Thus the pressure drop from the bowl to the shank bore is about the same as the pressure drop across the bit. In the present invention, there is a relatively large chamber 72 in the smoke passage. Chamber 72 does not cause any drawing problems if the ratio of the diameters of passageway 64 (about 0.280 inches) and bore 94 (about 0.125 inches) is between about 1.8 to about 2.5 with a presently preferred ratio being about 2.25. The function of the draw degrades significantly the closer the two diameters approach each other in size.

Similarly, there is a pressure drop from bowl horizontal passageway 64 to bowl vertical passageway 66. Too large a vertical passageway 66 and tobacco will drop therein or the tobacco will burn too hot and too quickly. An ideal diameter of vertical passageway 66 was experimentally found to be 0.125 inches. This is the same size as bit bore 94. Also, it was found that if the inner sides of inner bowl 46 do not converge symmetrically on vertical passageway 66, dottle forms in the bowl and the tobacco does not burn completely.

An optimum size for chamber 72 was experimentally found to have a height of 0.725 inches and a cross-section of 0.500 inches. Thus, the desired draw is achieved when chamber 72 size is much, much larger than either bore 94, passageway 64 or passageway 66.

The present invention, as mentioned above, provides a relatively large diameter bowl horizontal passageway 64 and the approximately same size inner barrel screw bore 136. This permits easy cleaning of passageway 64 from the bowl end (e.g. with a brush) without having to remove inner bowl 46.

The smoke is initially cooled when it comes into contact with the fresh air stream emitted into bowl horizontal passageway 64 through the jet plug bore 142. Obviously the diameter of bore 142 is also critical—too large a bore and the smoke will be too lean and too small a bore and the smoke will have insufficient cooling. Through experimentation, it was found that a bore 142 having a diameter from about 0.020 inches to about 0.050 inches, with a presently preferred range of 0.030 to 0.036 inches, works best with a bore of 0.036 and a vertical bore 66 of 0.140, the air is about 25% of the mixture.

The fresh air addition at the front bottom of inner bowl 46 cools the smoke earlier, keeps the bottom of bowl 46 cooler, reduces the temperature differentials throughout pipe 20, and reduces condensation buildup around inner bowl 46. Condensation is the worst problem in a pipe of the present type. It develops anywhere in the system where there is an air leak or where there is an obstruction, such as a small particle of tobacco caught in any of the passages of the smoke stream flow. Wetness anywhere in the system causes bite and condensation obviously causes wetness. Proper calibration of the length and diameter of the various smoke passages is necessary to reduce condensation outside chamber 98 and compartment 116. A principal location of early condensation is in horizontal passageway 64 between vertical passageway and the end of nipple 62. Passageway 66 could be located closer to nipple 62, but that has the aforementioned disadvantages. Another solution is to have horizontal passageway 64 on a slight rearward and downward slope to take advantage of gravity to carry the condensation to chamber 72. A 7 degree down angle is believed to be satisfactory. Another solution is to provide a countersunk rearward opening in place of nipple 62, thereby shortening passageway 64.

Pipe 20 in a further embodiment can also include and opening in the side of stem 24 near the rearward end thereof to provide a means for feeding outside air into the first phase cooling chamber 72. The size of the opening is critical and therefore it is designed to receive a plug having a small, metered opening therethrough for precise control of outside air flow. The plug may be press fit or threaded into the opening and, depending upon the smoker's preference, any number of plugs having different size openings can be selected and installed to produce a full flavored snoke (when the plug has a small opening or no opening at all) or a light smoke (when the plug has a relatively large opening).

It can be appreciated that the inner bowl 46 is provided with at least five separate systems for maintaining the bowl at a relatively cool temperature. First, the bowl is cooled by convection air flowing upwardly through the annular space between it and outer bowl 38. Second, cooling fins 48 are positioned in the air flow path to dissipate heat from the lower end and screen 47 abuts the upper end to further dissipate heat. Third, the upward air circulation is enhanced by the intermediate vents or openings 32 in base ring 28. Fourth, a longitudinal cooling flow path is provided by notch 50 which runs directly parallel to the smoke passageway 64 within the bowl. Five, fresh air is admitted to the forward end of horizontal passageway 64 where it both cools the smoke and the bottom of bowl 46. All of these features cooperate to keep inner bowl 46 cool and to prevent outer bowl 38 from becoming uncomfortable to the touch.

Once the smoke passes through horizontal passageway 64 and out through nipple 62, it then enters the first phase cooling chamber 72. In this chamber, the smoke flow is generally turbulent so that considerable heat is given off as the smoke passes out from nipple 62 to the inlet end of smoke passage tube 110. Once the smoke passes through smoke tube 110, it then enters the second phase cooling chamber 98 where it is constrained to flow about the S-shaped smoke passage discussed above. The smoke, having thus been cooled succesively as it travels from the combustion bowl to the bit end of mouthpiece 22, is now at a comfortable temperature for the enjoyment of the smoker.

While the smoke is passing through the successive cooling phases, various liquids present in the system are being collected within liquid absorbent tube 74. Condensate liquids which may collect about nipple 62 of inner bowl 46 will be absorbed as they drop down onto the outside of absorbent tube 74. More importantly, however, the greater volume of liquid which generally drains down from the smoker's mouth into the pipe will be fed through bore 94, over lip 118, across bottom 102, and through liquid tube 112 to the interior of absorbent tube 74. As mentioned above, lip 118 prevents these liquids from flowing back into the mouthpiece as the smoker draws on the pipe so that the liquids are entrapped and ultimately totally absorbed by absorbent tube 74.

All of the various portions of pipe 20 constructed in accordance with the present invention can be made of a suitable molded plastic material with the exception of the inner bowl 46 and the absorbent tube 74. Thus, pipe 20 can be manufactured quite economically and can be mass produced with little difficulty.

Because inner bowl 46 according to the present invention is a separate unit which can be easily replaced by merely unscrewing outer bowl 38, and barrel screw 134 the smoker may desire to purchase several different inner bowls which may be made of the same material or different materials. These bowls may be easily changed so that the smoker can enjoy several smokes without having to use the same bowl over and over again. Of course, because of the unique ability of the present invention to maintain liquids separate from the bowl, the necessity to "dry out" the pipe after each smoke is not nearly as great as it is with conventional pipes.

In a further embodiment, additional cooling can be obtained by providing an outer bowl 38 with a plurality of orifices through it.

Base ring 28 and collar 30 can also be provided with orifices. Preferably, the walls of the selected elements of bowl assembly 26 contain a large number of relatively small orifices spaced throughout the periphery in a geometrical design so that an aesthetically pleasing appearance is produced. The orifices can be produced by using an appropriately shaped, deep draft mold with hard surface cams for deep release after pressing each part. Alternatively, a collapsible mold having elements that extend through the material being moulded can be used.

From the foregoing, it can be appreciated that the present invention provides many distinct advantages and will result in a cool, flavorful smoke from beginning to end without the distasteful bite, foul taste, or unpleasant odors experienced in the past.

Inasmuch as the present invention is subject to many variations, modifications and changes in detail, it is intended that the foregoing description be interpreted as illustrative and not in a limiting sense.

I claim:

1. A smoker's pipe comprising a hollow stem defining a first cooling chamber;

a mouthpiece having a bore therethrough on rearward end of said stem;

a bowl assembly on the forward end of said stem, said bowl assembly including an outer bowl, an inner bowl having a combustion chamber therein and a longitudinally extending passageway through the bottom thereof below said combustion chamber and in fluid communication therewith, and means coupling said inner and outer bowls together so as to establish an annular air space therebetween all along the lengths thereof for the flow of cooling air around said inner bowl;

means for supplying fresh air to the forward end of said passageway;

means for establishing a smoke flow path between said passageway and said first cooling chamber; and means for establishing a smoke flow path between said first cooling chamber and said mouthpiece bore.

2. The pipe claimed in claim 1 wherein said mouthpiece comprises a bit at the rearward end, and a second cooling chamber at the forward end, and said mouthpiece bore connecting both ends; and said pipe further comprising a tube cluster removably sealingly mounted in said second cooling chamber and extending into said first cooling chamber, said tube cluster having a smoke passage tube disposed above a liquid tube, said smoke passage tube directing smoke from said first cooling chamber to said second cooling chamber, and means in said mouthpiece for constraining the smoke flow about a substantially S-shaped path for enhanced cooling and liquid separation.

3. The pipe claimed in claim 2 wherein said mouthpiece further includes a forward extending longitudinal partition dividing said second cooling chamber into upper and lower portions, said smoke tube extending into said upper portion beyond the forward end of said partition and said liquid tube in communication with said lower portion.

4. The pipe claimed in claim 3 wherein said upper and lower chamber portions have rearward, curved end walls, said curved end wall of said lower chamber portion meets said mouthpiece passage at a lip whereby liquids in said lower chamber portion are prevented from flowing back into said mouthpiece passage.

5. The pipe claimed in claim 3 wherein said stem defines a longitudinal bore under said inner bowl, said stem bore extending from an opening in the exterior of the stem to said first cooling chamber; and further including means disposed in said stem bore for absorbing liquids; and wherein said liquid tube extends from said lower chamber portion into coaxial alignment with said stem bore and into operational engagement with said absorbing means.

6. The pipe as claimed in claim 5 wherein said absorbing means comprises a removably disposable, hollow, cylindrical absorbent tube having an outside diameter less than the inner diameter of said stem bore, said absorbent tube being open at both ends; and wherein said liquid tube extends into one of said tube ends; said pipe further comprising a plug press fit within said stem bore, and said absorbent tube being mounted at the other end thereof onto said plug, said plug comprising means for defining vent passages to prevent pressure build-up within said absorbent tube.

7. The pipe as claimed in claim 5 wherein said plug further includes a head portion press fit into said stem bore and an integral, coaxial body portion having a reduced diameter such that said absorbent tube can be press fit concentrically about said body portion, and wherein said vent defining means comprises a plurality of lugs mounted spaced apart and axially extending on said stem body portion for engaging the end of said absorbent tube, said lugs defining said vent passages therebetween.

8. The pipe as claimed in claim 1 wherein said outer bowl terminates at the bottom end thereof above the bottom of said stem so as to define air flow passages which remain open when the pipe is placed on a flat surface.

9. The pipe as claimed in claim 1 wherein said outer bowl defines a plurality of air openings about the lateral periphery thereof intermediate the upper and lower ends of the bowl assembly.

10. The pipe as claimed in claim 1 wherein said inner bowl is generally cylindrical and contains a plurality of vertical cooling fins extending downwardly from an intermediate position on the exterior of said bowl below the bottom thereof, said fins having a notch therein so as to form a longitudinal channel said channel having a cooling groove formed centrally therein and said stem having longitudinally spaced apart means for supporting said inner bowl, said notch and said support means providing for the flow of air under the inner bowl, said inner bowl smoke passageway being parallel to said cooling groove and said inner bowl having a vertical smoke passageway connecting a mid portion of said horizontal passageway with said interior chamber of said inner bowl.

11. The pipe as claimed in claim 10 wherein said fresh air supplying means includes a means for sealingly engaging said inner bowl about said passageway forward end and for mounting said upper bowl in said pipe; and wherein said inner bowl has a cylindrical, horizontally, rearwardly protruding outlet, said horizontal smoke passageway extending coaxially through said protruding outlet; and wherein said first cooling chamber has a side wall which defines an aperture for receiving said protruding outlet; said pipe further including an airtight seal disposed about said outlet between a side wall of said inner bowl and the outer surface of the side wall of said chamber.

12. The pipe as claimed in claim 1 wherein said coupling means comprises an externally threaded barrel screw and a threaded orifice in said outer bowl for receiving said barrel screw so that said barrel screw can engage the forward end of said inner bowl and rigidly mounts said inner bowl about the bottom thereof inside said outer bowl.

13. The pipe as claimed in claim 12 wherein said barrel screw sealingly engages the periphery of the forward end of said inner bowl passageway and has a threaded internal bore; and said pipe further includes an externally threaded plug mounted in said screw bore and having a sized fresh air passageway therein for admitting a metered flow of fresh air into said inner bowl passageway.

14. The pipe as claimed in claim 1 wherein said fresh air supplying means comprises a orifice in said outer bowl, means defining an air flow between said orifice and the forward end of said inner bowl passageway, and air jet means for supplying a fine spray of air.

15. The pipe as claimed in claim 14 wherein said air jet means comprises a plug having a T-shaped bore therein, the longitudinal bore portion communicating with said outer bowl orifice and the transverse bore portion communicating with said inner bowl passageway.

16. A smoker's pipe comprising a hollow stem;

a mouthpiece having a longitudinal bore therein, said mouthpiece being removably mounted on the rearward end of said stem; and a bowl assembly mounted on the forward, upper portion of said stem, said outer bowl assembly comprising an outer bowl, an inner bowl of a refractory material and having walls which define an interior combustion chamber, the interior surface of said walls symmetrically converging about a centrally located, axial bore, said inner bowl also having a passageway longitudinally extending completely through the bottom portion thereof below said combustion chamber and in communication with said axial bore and with the interior of said stem, said interior wall surfaces being coated with an adhering, pyrolyzed carbon layer formed by heating a previously fired bowl that has been coated with a sugary substance to a high temperature, and said inner bowl having means for making said walls and the surfaces of said passageway nonporous to fluid flow therethrough, and means for mounting said inner bowl concentrically inside and spaced from said outer bowl.

17. The pipe as claimed in claim 16 wherein said inner bowl is of a glazable ceramic material, and wherein said nonporous making means comprises a coating of a glazing compound on the outside wall surfaces and on the surfaces defining said passageway.

18. The pipe as claimed in claim 17 wherein said inner bowl is generally cylindrical and contains a plurality of vertical cooling fins extending downwardly from an intermediate position on the exterior of said bowl below the bottom thereof, said fins having a notch therein so as to form a longitudinal channel said channel having a cooling groove formed centrally therein and said stem having longitudinally spaced apart means for supporting said inner bowl, said notch and said support means providing for the flow of air under the inner bowl, said inner bowl smoke passageway being parallel to said cooling groove and said inner bowl having a vertical smoke passageway connecting a mid portion of said longitudinal passageway with said interior combustion chamber of said inner bowl.

19. The pipe as claimed in claim 17 wherein said hollow stem defines a first cooling chamber and said mouthpiece further incliudes a second cooling chamber at the forward end thereof in communication with said bore;

said pipe further comprising a tube cluster disposed in said second cooling chamber and comprising a smoke passage tube having a bore therein for directing smoke from said first cooling chamber to said second cooling chamber, and a liquid drain tube disposed beneath said smoke tube for conveying liquid from said second cooling chamber to said first cooling chamber; means for establishing a tortuous flow path for said smoke so as to effect moisture separation and cooling; and lip means located at the juncture of said bore and said second cooling chamber for preventing liquids from flowing from said second cooling chamber into said bore.

20. The pipe as claimed in claim 19 wherein said flow path establishing means comprises a partition in said second cooling chamber spaced above the forward end of said mouthpiece bore and spaced below and extending forward beyond the rearward end of said smoke tube such that the smoke must flow about a substantially S-shaped path.

21. The pipe as claimed in claim 19 wherein said flow path establishing means comprises means for closing the forward end of said smoke tube and at least one orifice in the side of said smoke tube in communication with said bore therein.

22. A smoker's pipe comprising:

a hollow elongate stem having a forward end and a rearward end and having a cooling chamber therein, said cooling chamber having a normally upper smoke portion and a normally lower liquid portion;

a mouthpiece having a longitudinal bore therein and being mounted on the rearward end of said stem;

an outer bowl mounted on the forward portion of said stem and having an orifice located in the forward, lower portion thereof;

an inner bowl having walls which define an interior combustion chamber, an axially extending bore, and a passageway longitudinally extending completely through the bottom portion of said inner bowl below said combustion chamber and in communication with said axially extending bore, with said smoke portion of said cooling chamber at the rearward end, and with said outer bowl orifice at the forward end, said passageway having substantially the same diameter throughout so that said passageway can be cleaned through said outer bowl orifice and any tobacco particles can drop into said liquid portion of said cooling chamber; and means for mounting said inner bowl on said stem, concentrically inside and spaced from said outer bowl, said mounting means comprising means mounted in said outer bowl orifice for engaging said inner bowl about said forward passageway end and forcing said inner bowl into retaining engagement with a portion of said stem, and means for engaging the tops of said outer and inner bowls for centering said inner bowl top in said outer bowl.

23. A smoker's pipe as claimed in claim 22 wherein said outer bowl orifice is threaded; wherein said engaging means comprises an externally threaded barrel screw insertable in said outer bowl orifice; and further including O-ring sealing means comprised of an insulating material for providing a seal for the ends of said passageway, and wherein said barrel screw when threaded in said outer bowl orifice can engage the forward said O-ring sealing means and thereby can rigidly mount said inner bowl about the bottom thereof in said stem.

24. A smoker's pipe as claimed in claim 23 wherein said stem includes forward and rearward, spaced apart, mounting platforms on which said inner bowl rests such that a traversely extending cooling passage is defined therebetween.

25. A smoker's pipe as claimed in claim 22 and further comprising a forward sealing means for providing a fluid tight seal between said outer bowl orifice and said inner bowl forward passageway end and a rearward sealing means for providing a fluid tight seal between said inner bowl rearward passageway end and said smoke portion of said inner bowl cooling chamber.

26. A smoker's pipe comprising:

an elongate hollow stem having a chamber therein;

a mouthpiece mounted on the rearward end of said stem, and having a longitudinal bore therein in fluid communication with the rearward portion of said stem chamber;

a bowl mounted on the forward portion of said stem and in fluid communication with the forward portion of said stem chamber through a longitudinal passageway therein;

fluid tight means for dividing the inside of said stem chamber into said forward and rearward portions; and a smoke tube through said fluid tight means for providing fluid communication between said stem chamber forward and rearward portions, said smoke tube having a closed forward end and having at least one orifice in the side thereof.

* * * * *